US008508386B2

(12) United States Patent
Yamada

(10) Patent No.: US 8,508,386 B2
(45) Date of Patent: Aug. 13, 2013

(54) IN-VEHICLE INFORMATION PROCESSOR

(75) Inventor: Yuki Yamada, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 193 days.

(21) Appl. No.: 13/000,536

(22) PCT Filed: Jun. 4, 2009

(86) PCT No.: PCT/JP2009/060275

§ 371 (c)(1),
(2), (4) Date: Dec. 21, 2010

(87) PCT Pub. No.: WO2010/140238

PCT Pub. Date: Dec. 9, 2010

(65) Prior Publication Data

US 2011/0090094 A1 Apr. 21, 2011

(51) Int. Cl.
*G08G 1/09* (2006.01)

(52) U.S. Cl.
USPC ..... 340/905; 340/901; 340/907

(58) Field of Classification Search
USPC ..... 340/905
See application file for complete search history.

(56) References Cited

U.S. PATENT DOCUMENTS

| | | | | |
|---|---|---|---|---|
| 6,850,170 | B2 * | 2/2005 | Neff | 340/907 |
| 2005/0134478 | A1 | 6/2005 | Mese et al. | |
| 2007/0027583 | A1 * | 2/2007 | Tamir et al. | 701/1 |
| 2008/0266072 | A1 | 10/2008 | Suzuki | |
| 2009/0115632 | A1 * | 5/2009 | Park | 340/905 |
| 2011/0095906 | A1 | 4/2011 | Stählin | |

FOREIGN PATENT DOCUMENTS

| | | |
|---|---|---|
| GB | 2 452 835 A | 3/2009 |
| JP | 62 184600 | 8/1987 |
| JP | 2002 373396 | 12/2002 |
| JP | 2004 171459 | 6/2004 |
| JP | 2006 91003 | 4/2006 |
| JP | 2008 197725 | 8/2008 |
| JP | 2008 276327 | 11/2008 |
| WO | WO 2009/027173 A1 | 3/2009 |

OTHER PUBLICATIONS

International Search Report issued Jun. 30, 2009 in PCT/JP09/060275 filed Jun. 4, 2009.

International Preliminary Report on Patentability and Written Opinion issued Jan. 26, 2012, in PCT/JP2009/060275 filed Jun. 4, 2009.

* cited by examiner

*Primary Examiner* — Kerri McNally
(74) *Attorney, Agent, or Firm* — Oblon, Spivak, McClelland, Maier & Neustadt, L.L.P.

(57) ABSTRACT

In an in-vehicle information processor 100 including a communication device 104 which acquires traffic signal information regarding the lighting state of a traffic signal 401 and a display 106 which executes signal waiting time notification based on the traffic signal information acquired by the communication device 104, the display 106 starts the signal waiting time notification when the speed of a own vehicle 300 becomes equal to or smaller than a predetermined threshold value. For this reason, even in the case where the own vehicle 300 has stopped before the traffic signal for a certain reason although it tried to pass the traffic signal, the signal waiting time notification is performed again when the speed of the own vehicle 300 becomes equal to or smaller than the predetermined threshold value. Therefore, it becomes possible to perform the signal waiting time notification more accurately when necessary.

5 Claims, 7 Drawing Sheets

IN-VEHICLE INFORMATION PROCESSOR

TECHNICAL FIELD

The present invention relates to an in-vehicle information processor and in particular, to an in-vehicle information processor which provides the information based on the traffic signal information regarding the lighting state of a traffic signal.

BACKGROUND ART

A device which provides driving support using the time-series traffic signal information regarding the lighting state of a traffic signal has been proposed. For example, Patent Literature 1 discloses a system in which a DSRC transmitter, which transmits the traffic signal information, is provided in a traffic signal and an in-vehicle device is mounted in a vehicle. In this system, the traffic signal information is received by a DSRC receiver of the in-vehicle device, the lighting state and change timing of the traffic signal are acquired from the received information, and the lighting state and change timing of the traffic signal are displayed on a display device of the in-vehicle device so that the driver can drive after recognizing a time until the lighting state of the traffic signal changes.

CITATION LIST

Patent Literature

Patent Literature 1: Japanese Unexamined Patent Publication No. 2004-171459

SUMMARY OF INVENTION

Technical Problem

In the technique described above, however, there are no clear rules about the start conditions or the end conditions of display of the traffic signal information. Moreover, in the technique described above, once a screen which displays the traffic signal information regarding a certain traffic signal is removed, the traffic signal information regarding the traffic signal may not be displayed again thereafter. When a vehicle has stopped before a traffic signal for a certain reason although it tried to pass the traffic signal, the traffic signal information is necessary. However, in such a case, the traffic signal information may not be displayed again.

The present invention has been made in view of such a situation, and it is an object of the present invention to provide an in-vehicle information processor capable of providing the information based on the traffic signal information more accurately when necessary.

Solution to Problem

The present invention is an in-vehicle information processor which includes a traffic signal information acquisition unit, which acquires traffic signal information regarding a lighting state of a traffic signal and an information providing unit, which provides information based on the traffic signal information acquired by the traffic signal information acquisition unit, and in which the information providing unit starts providing the information based on the traffic signal information when the speed of a vehicle becomes equal to or smaller than a predetermined threshold value.

According to this configuration, in the in-vehicle information processor including the traffic signal information acquisition unit that acquires the traffic signal information regarding the lighting state of the traffic signal and the information providing unit that provides the information based on the traffic signal information acquired by the traffic signal information acquisition unit, the information providing unit starts providing the information based on the traffic signal information when the speed of the vehicle becomes equal to or smaller than the predetermined threshold value. For this reason, even in the case where the vehicle has stopped before the traffic signal for a certain reason although it tried to pass the traffic signal, the providing of the information based on the traffic signal information is performed again when the speed of the vehicle becomes equal to or smaller than the predetermined threshold value. Accordingly, it becomes possible to provide the information based on the traffic signal information more accurately when necessary.

In this case, it is preferable that the information providing unit ends the providing of the information based on the traffic signal information when the speed of the vehicle exceeds the predetermined threshold value while the information based on the traffic signal information is being provided.

According to this configuration, the information providing unit ends the providing of the information based on the traffic signal information when the speed of the vehicle exceeds the predetermined threshold value while the information based on the traffic signal information is being provided. For this reason, when the vehicle has passed the traffic signal and the providing of the information based on the traffic signal information is not necessary any more, the providing of the information is ended. Therefore, it is possible to prevent a driver from feeling inconvenienced or confused due to providing of unnecessary information.

In this case, it is preferable that after ending display of the information based on the traffic signal information when the speed of the vehicle exceeds the predetermined threshold value, the information providing unit resumes the providing of the information based on the traffic signal information when the speed of the vehicle becomes equal to or smaller than the predetermined threshold value and predetermined conditions excluding the speed of the vehicle are satisfied.

According to this configuration, after ending display of the information based on the traffic signal information when the speed of the vehicle exceeds the predetermined threshold value, the information providing unit resumes the providing of the information based on the traffic signal information when the speed of the vehicle becomes equal to or smaller than the predetermined threshold value and predetermined conditions excluding the speed of the vehicle are satisfied. For this reason, it is possible to prevent the information from being provided when the speed of the vehicle becomes equal to or smaller than the predetermined threshold value without a reasonable cause, such as a reduction in vehicle speed by a driver's intention or by chance, for example. Accordingly, it becomes possible to provide the information based on the traffic signal information more accurately when necessary.

In this case, preferably, the predetermined conditions refer to that another vehicle exists in front of the vehicle.

According to this configuration, when the cause in which the speed of the vehicle becomes equal to or smaller than the predetermined threshold value is a reasonable cause in which another vehicle exists in front of the vehicle, the providing of the information is resumed. Therefore, it becomes possible to provide the information based on the traffic signal information more accurately when necessary.

In this case, preferably, the predetermined conditions refer to that another vehicle exists in front of the vehicle and another vehicle is performing either a right turn or a left turn.

According to this configuration, when the cause in which the speed of the vehicle becomes equal to or smaller than the predetermined threshold value is a reasonable cause in which another vehicle exists in front of the vehicle and another vehicle is performing either a right turn or a left turn, the providing of the information is resumed. For this reason, it is possible to prevent the information from being provided when the speed of the vehicle becomes equal to or smaller than the predetermined threshold value without a reasonable cause, such as traffic congestion, for example. Accordingly, it becomes possible to provide the information based on the traffic signal information more accurately when necessary.

Advantageous Effects of Invention

According to the in-vehicle information processor of the present invention, it becomes possible to provide the information based on the traffic signal information more accurately when necessary.

DESCRIPTION OF EMBODIMENTS

Hereinafter, embodiments of an in-vehicle information processor related to the present invention will be described with reference to the drawings.

Figure 1:
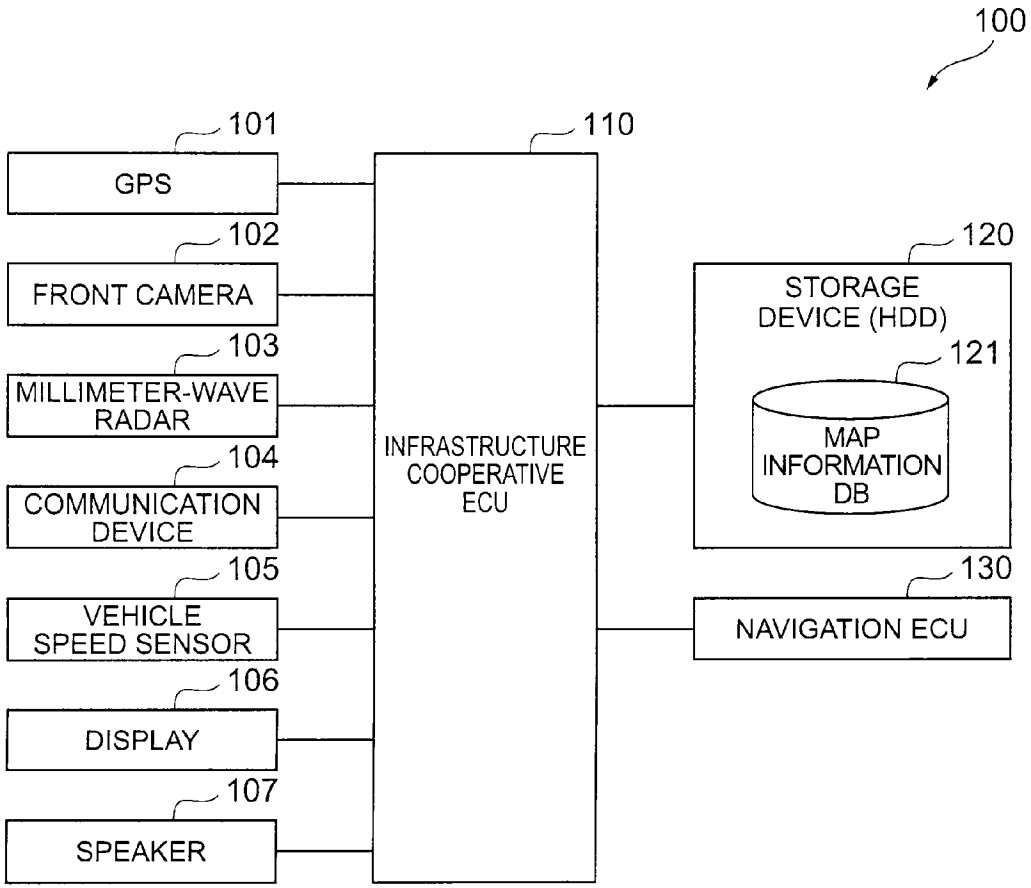
FIG. 1 is a block diagram showing the configuration of an in-vehicle information processor related to a first embodiment.

As shown in FIG. 1, an in-vehicle information processor 100 of a first embodiment of the present invention is configured by connecting a GPS 101, a front camera 102, a millimeter-wave radar 103, a communication device 104, a vehicle speed sensor 105, a display 106, a speaker 107, a storage device (HDD) 120, and a navigation ECU 130 to an infrastructure cooperative ECU 110. The in-vehicle information processor 100 of the present embodiment is a device for performing driving support by making the time-series traffic signal information regarding the lighting state of a traffic signal that the communication device 104 has received from roadside facilities, such as a light beacon, and the navigation information using the GPS 101 and the storage device 120 cooperate with each other.

The GPS (Global Positioning System) 101 is for receiving signals from a plurality of GPS satellites with a GPS receiver and for measuring the position of the own vehicle from differences of each signal.

The front camera 102 is used to acquire the speed (including the relative speed) and deceleration of a preceding vehicle, an inter-vehicle distance between the own vehicle and the preceding vehicle, and an inter-vehicle time between the own vehicle and the preceding vehicle by imaging the preceding vehicle in front of the own vehicle.

The millimeter-wave radar 103 is used to acquire the speed (including the relative speed) and deceleration of a preceding vehicle in front of the own vehicle, an inter-vehicle distance between the own vehicle and the preceding vehicle, and an inter-vehicle time between the own vehicle and the preceding vehicle. The radar 103 is a sensor which irradiates a millimeter wave to the front, receives a reflected wave which returns after being reflected by the object, and detects the speed and deceleration of a preceding vehicle, an inter-vehicle distance, and an inter-vehicle time.

The communication device 104 is specifically a light beacon receiver or a vehicle-to-vehicle communication device and is for acquiring the time-series traffic signal information regarding the lighting state of a traffic signal transmitted from a light beacon transmitter of the roadside facility or another vehicle. The lighting time information regarding a time remaining until a red signal of a traffic signal changes and the like are included in the time-series traffic signal information regarding the lighting state of the traffic signal. The vehicle speed sensor 105 is a sensor which detects a speed of the own vehicle from the number of revolutions of the axle.

The display 106 is for providing the driver with the lighting time information regarding a time remaining until a red signal of a traffic signal changes and the like by screen display, as will be described later. The speaker 107 is for providing the driver with the lighting time information regarding a time remaining until a red signal of a traffic signal changes and the like by sound.

The storage device (HDD: hard disk drive) 120 has a map information DB 121 in which the map information is recorded, so that the infrastructure cooperative ECU 110 and the navigation ECU 130 can acquire not only the positioning information regarding the own vehicle acquired by the GPS 101 and the information regarding a course along which the own vehicle is traveling, a mileage, and the like. Alternatively, the time-series traffic signal information regarding the past lighting state of a traffic signal in each location is recorded in the storage device 120.

The infrastructure cooperative ECU 110 provides the driver with the lighting time information regarding a time remaining until a red signal of a traffic signal changes and the like, through the display 106 and the speaker 107, on the basis of the time-series traffic signal information regarding the lighting state of the traffic signal that the communication device 104 received from the light beacon transmitter, the information regarding a course along which the own vehicle is traveling, a mileage, and the like acquired from the positioning information of the GPS 101 and the map information DB 121, the speed of the own vehicle acquired by the vehicle speed sensor 105, the information regarding vehicles in front and the traffic signal acquired by the millimeter wave 103 and the camera 102, and the time-series traffic signal information regarding the past lighting state of the traffic signal in each location which is recorded in the storage device 120.

The navigation ECU 130 is for performing routing assistance to the driver of the own vehicle using the display 106 or the speaker 107 on the basis of the information regarding a course along which the own vehicle is traveling, a mileage, and the like which is acquired from the positioning information of the GPS 101 and the map information DB 121, the speed of the own vehicle acquired by the vehicle speed sensor 105, and the information regarding the traffic situation received from a light beacon transmitter of the roadside infrastructure by the communication device 104.

Moreover, in the present embodiment, the front camera 102, the millimeter-wave radar 103, the communication device 104, and the navigation ECU 130 may not be provided. In addition, the infrastructure cooperative ECU 110 may include the navigation ECU 130.

Figure 2:
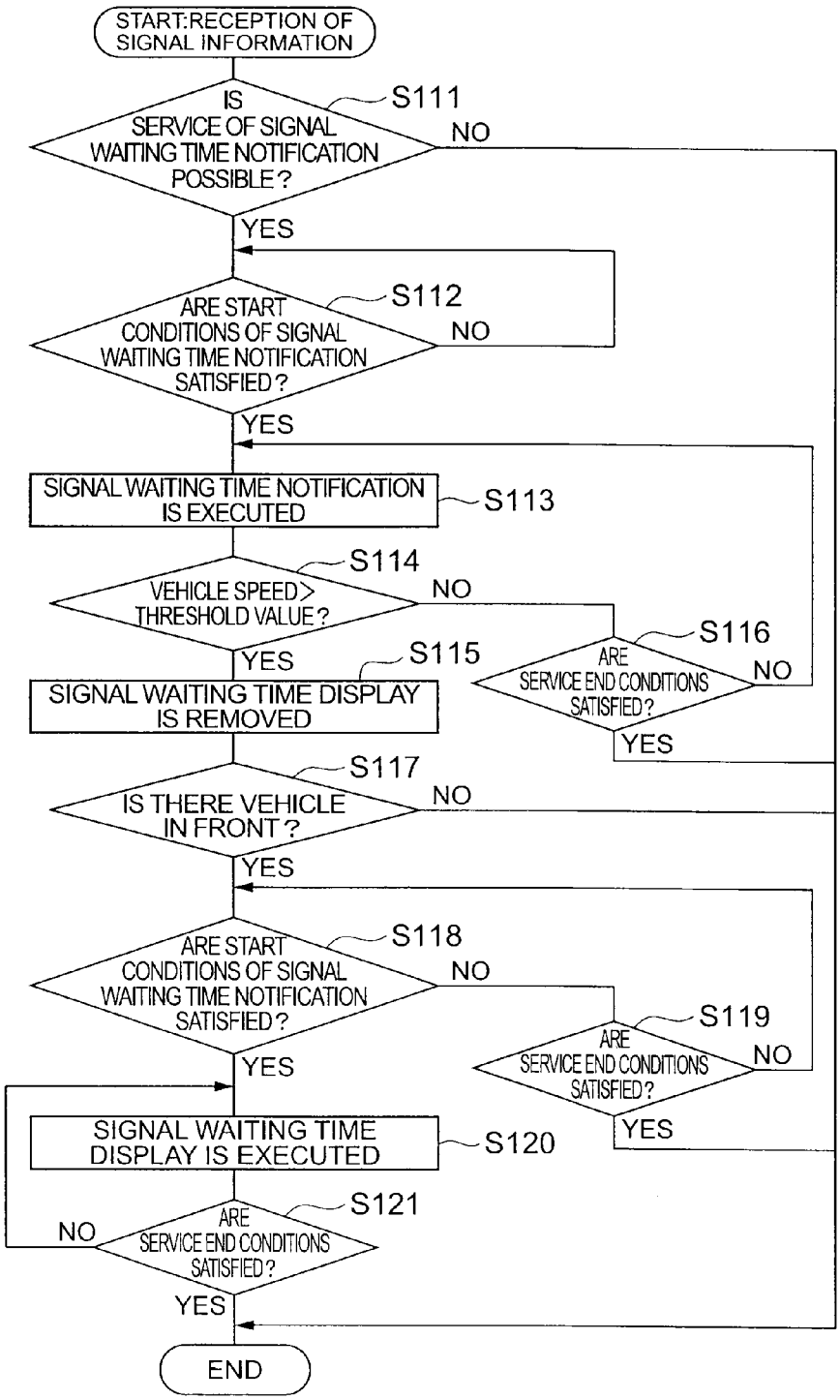
FIG. 2 is a flow chart showing an operation of the in-vehicle information processor related to the first embodiment.

Hereinafter, an operation of the driving support apparatus 100 of the present embodiment will be described. As shown in FIG. 2, it is assumed that the infrastructure cooperative ECU 110 receives, through the communication device 104, the time-series traffic signal information regarding the lighting state of a traffic signal from a light beacon transmitter of the roadside infrastructure or a vehicle-to-vehicle communication device or acquires the time-series traffic signal information regarding the past lighting state of a traffic signal in each location which is recorded in the storage device 120.

The infrastructure cooperative ECU 110 determines as a premise whether or not a service of notification of a signal waiting time is possible using the acquired traffic signal information (S111). When a time remaining until a red signal of a traffic signal changes is shorter than a predetermined time (for example, 1 to 5 seconds) or when the time remaining until a red signal of a traffic signal changes cannot be specified, the infrastructure cooperative ECU 110 does not execute the service of notification of a signal waiting time.

The infrastructure cooperative ECU 110 determines whether or not the start conditions of signal waiting time notification are satisfied (S112). The start conditions of the signal waiting time notification refer to that the speed of the own vehicle detected by the vehicle speed sensor 105 is equal to or smaller than a predetermined threshold value (40 km/h, more preferably 20 km/h, much more preferably 10 km/h). In addition, the start conditions of the signal waiting time notification refer to that a red signal is lit, there is no traffic signal between the traffic signal and the own vehicle, and the like.

Figure 3:
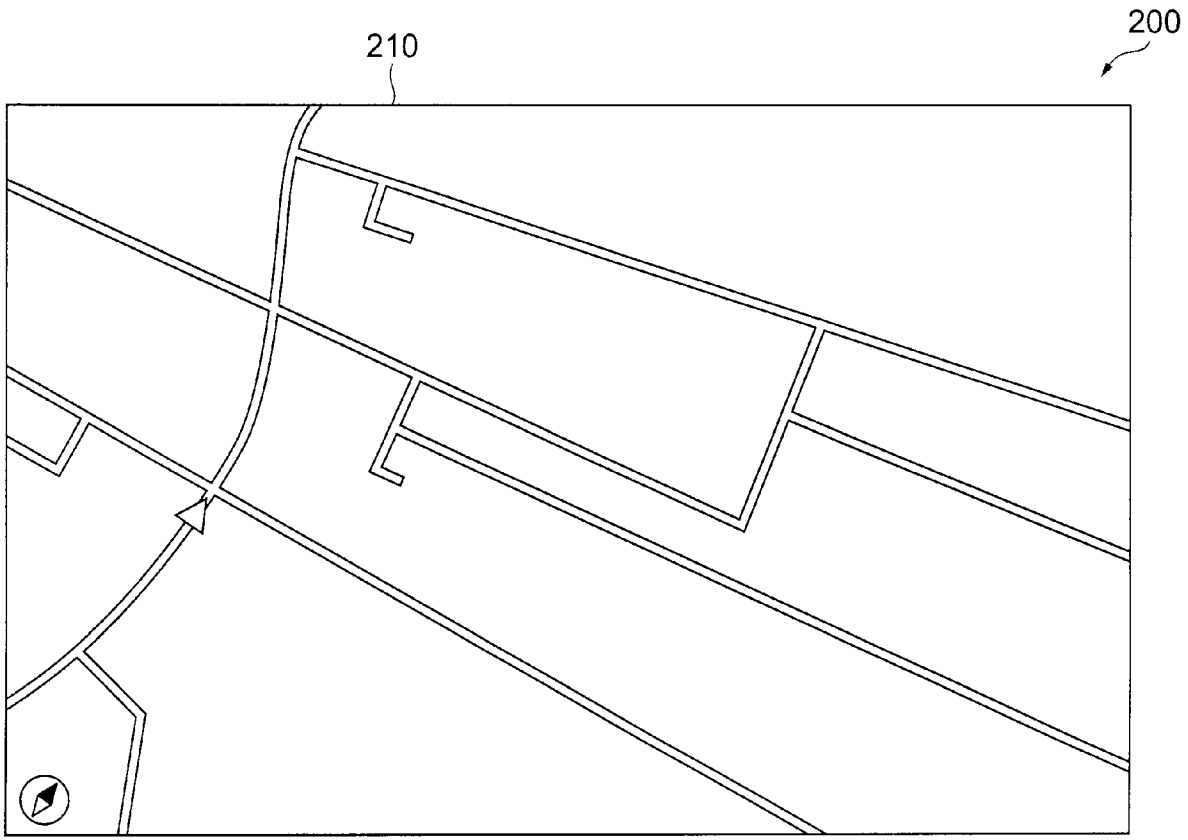
FIG. 3 is a view showing an example of a display screen at the time of routing assistance.

When the start conditions of the signal waiting time notification are satisfied (S112), the infrastructure cooperative ECU 110 displays a signal waiting time on the display 106 or performs sound notification using the speaker 107 (S113). As shown in FIG. 3, when the signal waiting time notification is not performed, a 2D map display 210 indicating the current position of the own vehicle is displayed on the entire screen display 200 of the display 106. On the other hand, as shown in FIG. 4, when the signal waiting time notification is performed, the 2D map display 210 indicating the current position of the own vehicle is displayed on the left half screen of the screen display 200 of the display 106, and a 3D driver's view display 220 near the intersection of a traffic signal through which the current own vehicle is going to pass is displayed on the right half screen.

It is difficult for a driver to make a determination regarding whether or not a service, such as the notification of a signal waiting time, is executable. Therefore, in the present embodiment, a service display icon 230 indicating that a signal waiting time notification service is being executed is displayed on the screen display 200 and a remaining time of a red signal is displayed at intervals of 5 seconds in a signal remaining time display icon 240 so that the driver easily understands it. Alternatively, notification regarding whether or not a signal waiting time notification service is executable may be performed by sound in advance using the speaker 107.

Moreover, in the present embodiment, when next signals of some red signals are unknown, the traffic signal information of "acquired" is displayed on a signal cycle display bar 250, and a time for which a remaining time of a red signal from the acquisition time of the traffic signal information can be displayed is displayed on an acquired signal cycle time display 251.

Figure 4:
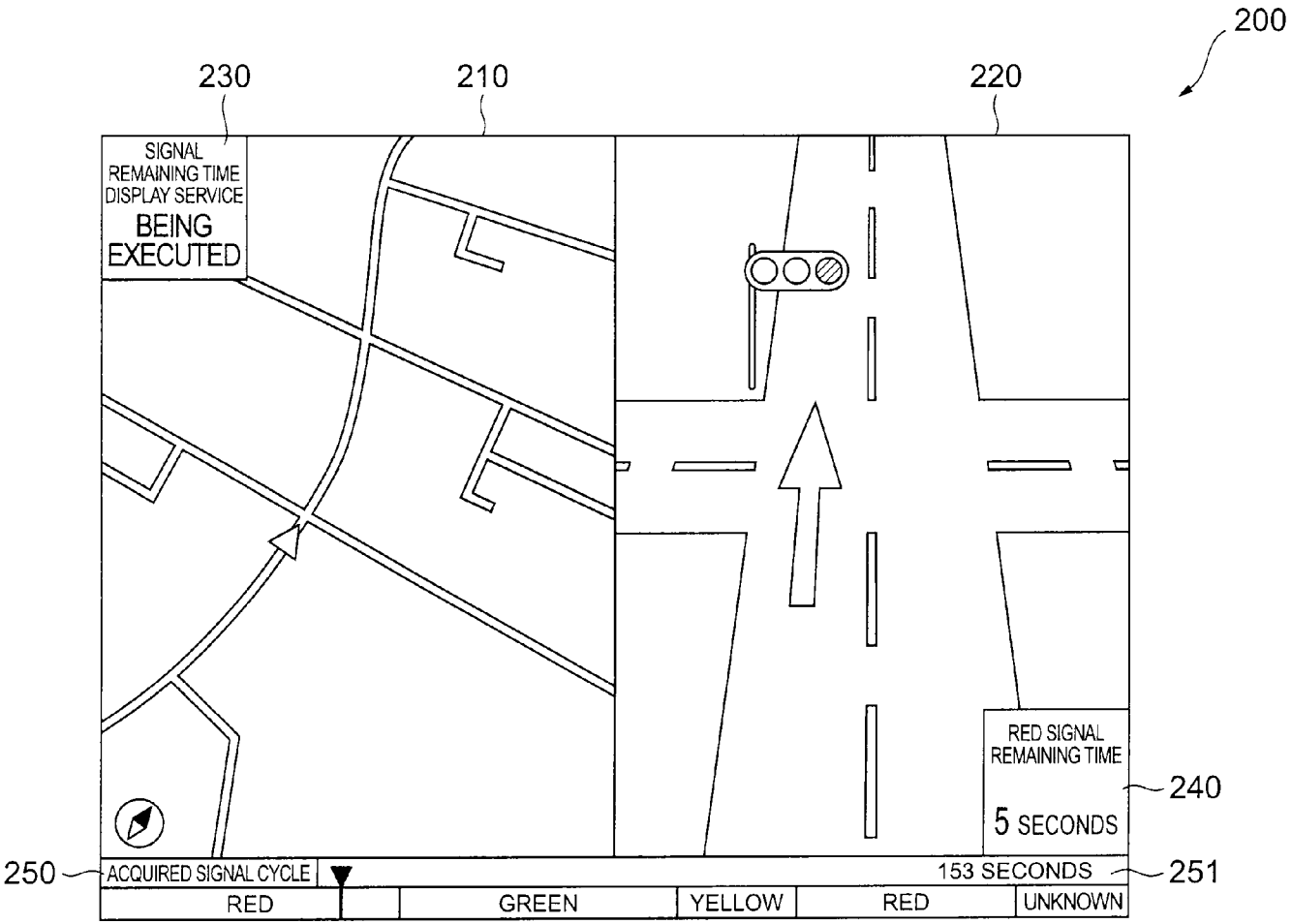
FIG. 4 is a view showing an example of a display screen when executing a signal waiting time notification service.

Returning to FIG. 2, when the speed of the own vehicle detected by the vehicle speed sensor 105 exceeds a predetermined threshold value (40 km/h, more preferably 20 km/h, much more preferably 10 km/h, which may be a different value from the threshold value of the start conditions of the signal waiting time notification) (S114), the infrastructure cooperative ECU 110 removes the display of a signal waiting time from the display 106 and returns from the screen display 200 shown in FIG. 4 to the screen display shown in FIG. 3 (S115).

Moreover, even if the speed of the own vehicle detected by the vehicle speed sensor 105 does not exceed the predetermined threshold value (S114), when the service end conditions are satisfied, for example, when the own vehicle has moved to the outside of the service area where a traffic signal does not influence traveling of the own vehicle, when the driver performs setting for the end of the service, and when lighting of a red signal ends (S116), the infrastructure cooperative ECU 110 ends the processing of the signal waiting time notification. Moreover, the service end conditions may be determined by a driving tendency of a driver, for example, a driver's tendency to pass the intersection by sudden acceleration, which is shown in driving history recorded in a driving history DB, in a state where the driving history DB which records the driving history for every driver in the storage device 120 is additionally provided.

Figure 5:
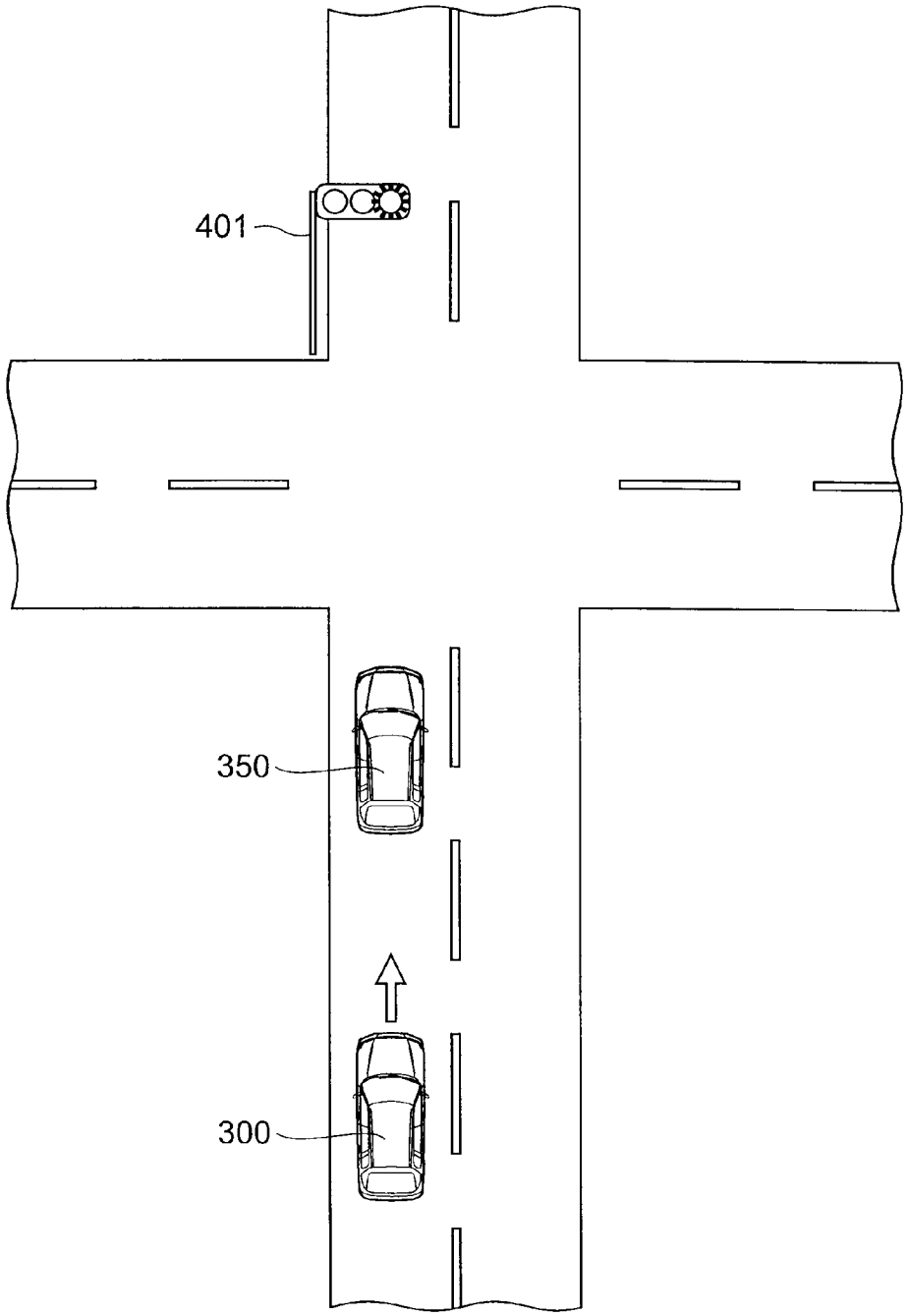
FIG. 5 is a plan view showing the situation when resuming signal waiting time notification in the first embodiment.

The infrastructure cooperative ECU 110 determines whether or not there is another vehicle in front of the own vehicle (117). In this case, as shown in FIG. 5, it is determined whether or not there is another vehicle 350 between a traffic signal 401 and an own vehicle 300, between a stop line of the traffic signal 401 and the own vehicle 300, or between an intersection and the own vehicle 300.

Determination regarding whether or not there is another vehicle 350 in front of the own vehicle 300 can be performed on the basis of a determination result of another vehicle 350 using the front camera 102 and the millimeter-wave radar 103 or vehicle-to-vehicle notification between the own vehicle 300 and another vehicle 350 using the communication device 104. As will be described later, the determination regarding whether or not there is another vehicle 350 in front of the own vehicle 300 is performed in order to determine whether or not a repeated slowdown or stopping of the own vehicle 300 is due to another vehicle 350 in front. Therefore, when a slowdown or stopping of the own vehicle 300 occurs, it may be determined that there is another vehicle 350 between the own vehicle 300 and the stop line on the basis of the distance between the own vehicle 300 and the stop line of the traffic signal 401.

When it is determined that there is another vehicle 350 in front of the own vehicle 300 (S117), the infrastructure cooperative ECU 110 determines whether or not the start conditions of the signal waiting time notification are satisfied, for example, whether or not the speed is equal to or smaller than a predetermined threshold value, similar to S112. When the start conditions of the signal waiting time notification are not satisfied (S118) and the service end conditions similar to S116 are satisfied (S119), the infrastructure cooperative ECU 110 ends the processing of the signal waiting time notification.

When the start conditions of the signal waiting time notification are satisfied (S118), the infrastructure cooperative ECU 110 restarts the signal waiting time notification similar to S113. When the service end conditions similar to S116 are satisfied (S121), the infrastructure cooperative ECU 110 ends the processing of the signal waiting time notification.

According to the present embodiment, in the in-vehicle information processor 100 including the communication device 104 which acquires the traffic signal information regarding the lighting state of the traffic signal 401 and the display 106 which executes the signal waiting time notification based on the traffic signal information acquired by the communication device 104, the display 106 starts the signal waiting time notification when the speed of the own vehicle 300 becomes equal to or smaller than a predetermined threshold value. For this reason, even in the case where the own vehicle 300 has stopped before the traffic signal for a certain reason although it tried to pass the traffic signal, the signal waiting time notification is performed again when the speed of the own vehicle 300 becomes equal to or smaller than the predetermined threshold value. Therefore, it becomes possible to perform the signal waiting time notification more accurately when necessary.

Moreover, according to the present embodiment, when the speed of the own vehicle 300 exceeds a predetermined threshold value while the display 106 is performing signal waiting time notification, the display 106 ends the signal waiting time notification. Accordingly, when the own vehicle 300 has passed a traffic signal and the notification of a signal waiting time is not necessary any more, the signal waiting time notification is ended. Therefore, it is possible to prevent a driver from feeling inconvenienced or confused due to providing of unnecessary information.

Moreover, in the present embodiment, after ending signal waiting time notification when the speed of the own vehicle 300 exceeds a predetermined threshold value, the display 106 resumes the signal waiting time notification only when the speed of the own vehicle 300 is equal to or smaller than the predetermined threshold value and predetermined conditions excluding the speed of the own vehicle 300 are satisfied. For this reason, it is possible to prevent signal waiting time notification from being performed when the speed of the own vehicle 300 becomes equal to or smaller than the predetermined threshold value without a reasonable cause, such as a reduction in vehicle speed by a driver's intention or by chance, for example. Therefore, it becomes possible to perform the signal waiting time notification more accurately when necessary.

Hereinafter, a second embodiment of the present invention will be described. In the present embodiment, the notification of a signal waiting time is restarted only when another vehicle 350 exists ahead and another vehicle 350 turns right or left.

Figure 6:
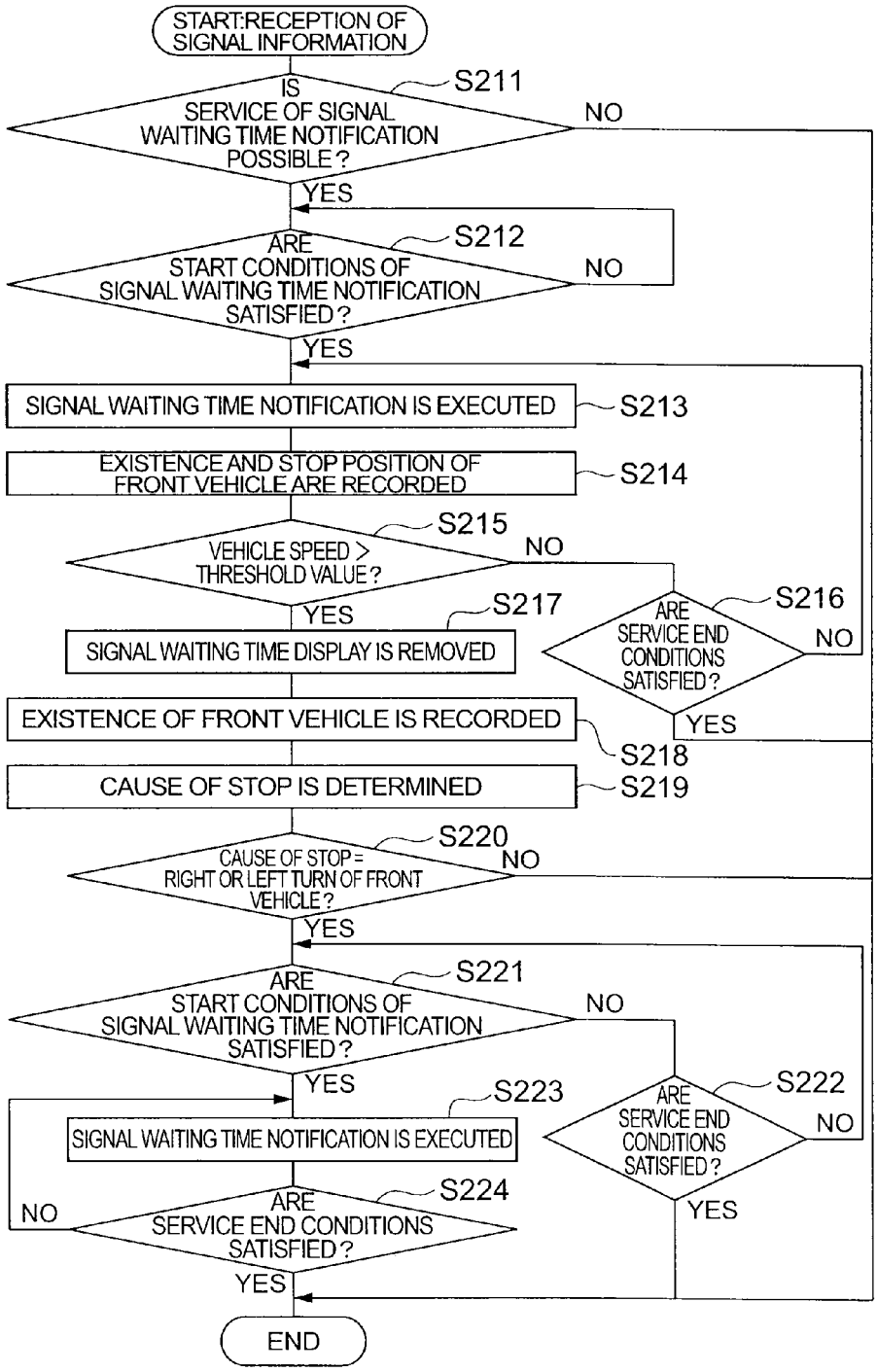
FIG. 6 is a flow chart showing an operation of an in-vehicle information processor related to a second embodiment.

As shown in FIG. 6, processing of S211 to S213 is performed similar to S111 to S113 of FIG. 2 in the first embodiment described above. While executing the signal waiting time notification (S213), the infrastructure cooperative ECU 110 records the existence of another vehicle 350 in front, which is detected by the front camera 102, the millimeter-wave radar 103, and vehicle-to-vehicle communication using the communication device 104 or the like, and the stopping position of the vehicle 300 (S214).

When the speed of the vehicle 300 becomes large enough to exceed a threshold value, the infrastructure cooperative ECU 110 ends the signal waiting time notification (S215 to S217), similar to S114 to S116 of FIG. 2 in the first embodiment described above. The infrastructure cooperative ECU 110 records the existence of another vehicle 350 in front (S218).

The infrastructure cooperative ECU 110 determines the cause of a slowdown or stopping of the own vehicle 300 on the basis of the stopping position of the own vehicle 300 and the behavior of another vehicle 350 in front in S214 and S218 (S219).

Figure 7:
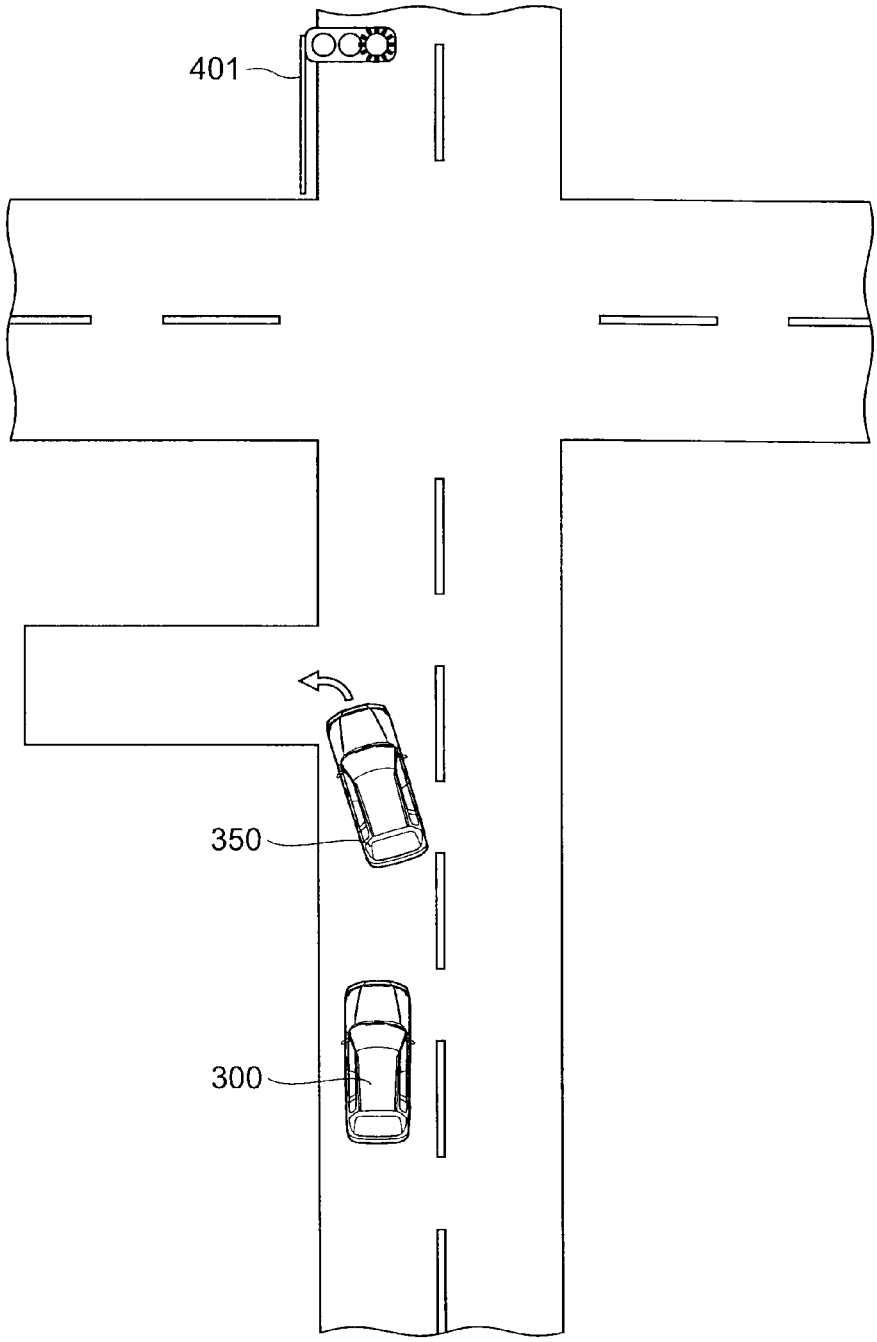
FIG. 7 is a plan view showing the situation when resuming signal waiting time notification in the second embodiment.

In the cases of the following (1) to (11), the infrastructure cooperative ECU 110 determines that the cause of a slowdown or stopping of the own vehicle 300 is a right turn or a left turn of another vehicle 350 in front as shown in FIG. 7. In the case of a combination of the following (1) to (11), the infrastructure cooperative ECU 110 may determine that the cause of a slowdown or stopping of the own vehicle 300 is a right turn or a left turn of another vehicle 350 in front.

(1) Sudden increase in the inter-vehicle distance from another vehicle 350 in front A sudden increase in the distance from another vehicle 350 in front or a sudden undetectable state of another vehicle 350 can be determined as a right or a left turn of another vehicle 350. When the displacement of the inter-vehicle distance from another vehicle 350 measured by the front camera 102 and the millimeter-wave radar 103 is larger than a predetermined threshold value, it is determined as a right or a left turn of another vehicle 350.

(2) Long distance remaining until the stop line of the traffic signal 401

Similar to the first embodiment, a long distance remaining until the stop line of the traffic signal 401 can be determined as a right or a left turn of another vehicle 350. The distance remaining until the stop line of the traffic signal 401 can be determined by the vehicle speed detected by the vehicle speed sensor 105 or the navigation ECU 130, the information regarding the road shape of an intersection detected by the navigation ECU 130, and the positional information based on road-to-vehicle communication between a light beacon transmitter or the like and the navigation ECU 130, the front camera 102, or the communication device 104.

(3) Large acceleration after stopping of the own vehicle 300

Large acceleration after stopping can be determined as a right or a left turn of another vehicle 350 unlike a case such as traffic congestion. The acceleration after stopping of the own vehicle 300 is determined by the vehicle speed detected by the vehicle speed sensor 105 or the navigation ECU 130 or a measurement value of accelerator depressing amount or throttle opening.

(4) Long moving distance after the own vehicle 300 departs again

A long moving distance after the own vehicle 300 departs again can be determined as a right or a left turn of another vehicle 350 unlike a case such as traffic congestion. The moving distance after the own vehicle 300 departs again is determined by the vehicle speed detected by the vehicle speed sensor 105 or the navigation ECU 130 or the positional information or the like using the GPS 101.

(5) Lighting of a turn signal of another vehicle 350 in front

Lighting of a turn signal of another vehicle 350 in front is determined by the front camera 102 or vehicle-to-vehicle communication with another vehicle 350 using the communication device 104.

(6) Left or right inclination of another vehicle 350 in front or being close to the destination of another vehicle 350 in front Left or right inclination of another vehicle 350 in front or being close to the destination can be determined as a right or a left turn of another vehicle 350 unlike a case such as traffic congestion. Left or right inclination of another vehicle 350 in front or being close to the destination is determined by the front camera 102 or vehicle-to-vehicle communication with another vehicle 350 using the communication device 104.

(7) Empty space in front of another vehicle 350 ahead

Empty space in front of another vehicle 350 ahead can be determined as a right or a left turn of another vehicle 350 unlike a case such as traffic congestion. Empty space in front of another vehicle 350 ahead is determined by receiving the information of a camera or a radar, which is mounted at the front of another vehicle 350, through vehicle-to-vehicle communication using the communication device 104 or by receiving the information from the roadside infrastructure through road-to-vehicle communication using the communication device 104.

(8) Determination based on traffic flow

For example, stopping of another vehicle 350 at a position distant from the stop line despite low traffic flow can be determined as a right or a left turn of another vehicle 350 unlike a case such as traffic congestion. The traffic flow is determined by receiving the information from the front camera 102, the navigation ECU 130 or the roadside infrastructure through road-to-vehicle communication using the communication device 104.

(9) Slowdown or stopping of the own vehicle 300 after lighting of a green signal Slowdown or stopping of the own vehicle 300 after lighting of a green signal can be determined as a right or a left turn of another vehicle 350. Slowdown or stopping of the own vehicle 300 after lighting of a green signal is determined by the vehicle speed detected by the vehicle speed sensor 105, the traffic signal information received from the roadside infrastructure through road-to-vehicle communication using the communication device 104, or the traffic signal information acquired by the front camera 102.

(10) Slowdown or stopping of the own vehicle 300 even though the traffic signal 401 is not seen from the own vehicle 300

Slowdown or stopping of the own vehicle 300 even though the traffic signal 401 is not seen from the own vehicle 300 can be determined as a right or a left turn of another vehicle 350. Slowdown or stopping of the own vehicle 300 even though the traffic signal 401 is not seen from the own vehicle 300 is determined by the vehicle speed detected by the vehicle speed sensor 105, the geographical information received from the front camera 102, the millimeter-wave radar 103 or the roadside infrastructure through road-to-vehicle communication using the communication device 104, or the information regarding the situation in front received from another vehicle through vehicle-to-vehicle communication using the communication device 104.

(11) Showing the intention of wishing the resumption of signal waiting time notification by a switch operation or the like by a driver of the vehicle 300

Showing the intention of wishing the resumption of signal waiting time notification by a switch operation or the like by a driver of the own vehicle 300 can be determined as a right or a left turn of another vehicle 350. For example, a redisplay button is provided in the display 106. Then, if the start conditions of signal waiting time notification are satisfied when the redisplay button is pressed, the signal waiting time notification can be displayed again.

When it is determined that the cause of a slowdown or stopping of the own vehicle 300 is a right or a left turn of another vehicle in front (S220), the infrastructure cooperative ECU 110 resumes the signal waiting time notification (S223) on condition that the start conditions of signal waiting time notification are satisfied similar to S118 in the first embodiment described above (S221) and the service end conditions are not satisfied similar to S119 in the first embodiment described above (S222). When the service end conditions are satisfied similar to S121 in the first embodiment described above (S224), the infrastructure cooperative ECU 110 ends the processing of the signal waiting time notification.

According to the present embodiment, when the cause in which the speed of the own vehicle 300 becomes equal to or smaller than a predetermined threshold value is a reasonable cause in which another vehicle 350 exists in front of the own vehicle 300 and another vehicle 350 is performing either a right turn or a left turn, the signal waiting time notification is resumed. For this reason, it is possible to prevent signal waiting time notification from being performed when the speed of the own vehicle 300 becomes equal to or smaller than the predetermined threshold value without a reasonable cause, such as traffic congestion, for example. Accordingly, it becomes possible to provide the information based on the traffic signal information more accurately when necessary.

While the embodiments of the present invention have been described, the present invention is not limited to the above-described embodiments and various modifications may also be made.

INDUSTRIAL APPLICABILITY

According to the in-vehicle information processor of the present invention, it becomes possible to provide the information based on the traffic signal information more accurately when necessary.

REFERENCE SIGNS LIST

100: in-vehicle information processor
101: GPS
102: front camera
103: millimeter-wave radar
104: communication device
105: vehicle speed sensor
106: display
107: speaker
110: infrastructure cooperative ECU
120: storage device (HDD)
121: map information DB
130: navigation ECU
200: screen display
210: 2D map display
220: 3D driver's view display
230: service display icon
240: signal remaining time display icon
250: signal cycle display bar
251: acquired signal cycle time display
300: own vehicle
350: another vehicle
401: traffic signal

The invention claimed is:

1. An in-vehicle information processor comprising:

a traffic signal information acquisition unit that acquires traffic signal information regarding a lighting state of a traffic signal; and an information providing unit that provides information based on the traffic signal information acquired by the traffic signal information acquisition unit, wherein the information providing unit starts providing the information based on the traffic signal information in response to detecting that a speed of a vehicle approaching the traffic signal is equal to or smaller than a predetermined threshold value that is a non-zero speed.

2. The in-vehicle information processor according to claim 1, wherein the information providing unit ends the providing of the information based on the traffic signal information when the speed of the vehicle exceeds the predetermined threshold value while the information based on the traffic signal information is being provided.

3. The in-vehicle information processor according to claim 2, wherein after ending the providing of the information based on the traffic signal information when the speed of the vehicle exceeds the predetermined threshold value, the information providing unit resumes the providing of the information based on the traffic signal information when the speed of the vehicle becomes equal to or smaller than the predetermined threshold value and predetermined conditions excluding the speed of the vehicle are satisfied.

4. The in-vehicle information processor according to claim 3, wherein the predetermined conditions refer to that another vehicle exists in front of the vehicle.

5. The in-vehicle information processor according to claim 4, wherein the predetermined conditions refer to that another vehicle exists in front of the vehicle and another vehicle is performing either a right turn or a left turn.

* * * * *